US010435861B2

(12) United States Patent
Love et al.

(10) Patent No.: US 10,435,861 B2
(45) Date of Patent: Oct. 8, 2019

(54) PAD SITE CONSTRUCTION AND METHOD

(71) Applicant: TorcSill Foundations, LLC, Pasadena, TX (US)

(72) Inventors: Lyle G. Love, Weatherford, OK (US); Aaron Wheeler, Pasadena, TX (US); Jeff Sullivan, Pasadena, TX (US)

(73) Assignee: TORCSILL FOUNDATIONS, LLC, Pasadena, TX (US)

( * ) Notice: Subject to any disclaimer, the term of this patent is extended or adjusted under 35 U.S.C. 154(b) by 0 days.

(21) Appl. No.: 16/021,567

(22) Filed: Jun. 28, 2018

(65) Prior Publication Data

US 2019/0003143 A1 Jan. 3, 2019

Related U.S. Application Data

(60) Provisional application No. 62/527,454, filed on Jun. 30, 2017.

(51) Int. Cl.

| | |
|---|---|
| ***E21B 15/00*** | (2006.01) |
| ***E02B 17/00*** | (2006.01) |
| ***E02D 27/02*** | (2006.01) |
| ***E02D 7/00*** | (2006.01) |
| ***E21B 7/02*** | (2006.01) |
| ***E02D 5/56*** | (2006.01) |
| ***E02D 9/00*** | (2006.01) |
| ***E21B 43/30*** | (2006.01) |

(52) U.S. Cl.

CPC ..... *E02D 27/02* (2013.01); *E02D 5/56* (2013.01); *E02D 7/00* (2013.01); *E02D 9/00* (2013.01); *E21B 7/02* (2013.01); *E21B 15/003* (2013.01); *E21B 43/30* (2013.01); *E02B 2017/0056* (2013.01); *E02D 2220/00* (2013.01); *E02D 2250/00* (2013.01); *E02D 2300/0079* (2013.01)

(58) Field of Classification Search

CPC ..... E21B 15/00; E21B 15/003; E21B 41/08; E02B 2017/0056

See application file for complete search history.

(56) References Cited

U.S. PATENT DOCUMENTS

| | | | | |
|---|---|---|---|---|
| 3,878,662 A * | 4/1975 | Cernosek | E02B 17/00 | 52/169.9 |
| 6,161,358 A * | 12/2000 | Mochizuki | E21B 15/00 | 405/201 |
| 6,745,852 B2 * | 6/2004 | Kadaster | E02B 17/00 | 175/5 |
| 7,410,327 B2 * | 8/2008 | Baugh | E02D 27/35 | 405/204 |
| 8,226,326 B2 * | 7/2012 | Baugh | E02D 27/35 | 405/131 |
| 8,376,659 B2 * | 2/2013 | Baugh | E21B 7/008 | 166/901 |

(Continued)

*Primary Examiner* — Frederick L Lagman

(74) *Attorney, Agent, or Firm* — MH2 Technology Law Group LLP

(57) ABSTRACT

A pad site and a method for supporting a rig structure, of which the method includes positioning a plurality of piles in a ground of a core operating section of a pad site, and laying a plurality of mats over the pad site. A first portion of the plurality of mats are at least partially supported by the plurality of piles, and a second portion of the plurality of mats are not supported by the plurality of piles. The first portion of the plurality of mats are configured to support a rig structure.

22 Claims, 6 Drawing Sheets

(56) References Cited

U.S. PATENT DOCUMENTS

| | | | | |
|---|---|---|---|---|
| 8,950,980 | B2 * | 2/2015 | Jones | E02D 27/44 405/230 |
| 9,109,399 | B2 * | 8/2015 | Murr | E21B 7/02 |
| 2002/0074125 | A1 * | 6/2002 | Fikes | E21B 15/003 166/352 |
| 2004/0060739 | A1 * | 4/2004 | Kadaster | E02B 17/00 175/57 |
| 2004/0200641 | A1 * | 10/2004 | Jones | E21B 15/003 175/57 |
| 2007/0163186 | A1 * | 7/2007 | Baugh | E02D 27/35 405/217 |
| 2013/0153309 | A1 * | 6/2013 | Smith | B62D 57/02 180/8.1 |
| 2013/0269268 | A1 * | 10/2013 | Thiessen | E21B 15/00 52/118 |
| 2016/0280524 | A1 * | 9/2016 | Crisp | B65G 7/00 |
| 2016/0312596 | A1 * | 10/2016 | Leroux | E21B 7/02 |
| 2018/0127943 | A1 * | 5/2018 | Kadrmas | E02D 5/285 |

* cited by examiner

PAD SITE CONSTRUCTION AND METHOD

CROSS-REFERENCE TO RELATED APPLICATIONS

This application claims priority to U.S. Provisional Patent Application No. 62/527,454, which was filed on Jun. 30, 2017 and is incorporated herein by reference in its entirety.

BACKGROUND

Pad drilling is the process of drilling several wells in an area, with the goal being to efficiently extract hydrocarbons (or other fluids in a subterranean reservoir) from the several wells in parallel. "Walking" rigs are sometimes employed for pad drilling. Walking rigs include devices and structures that give the rigs the ability to move from one well center to another, separated by a relatively short distance, and drill the wells in sequence, while minimizing the non-drilling time required to move the rig.

Typically, the ground is too soft, is not sufficiently level, or otherwise is not conducive, in its natural state, to such walking operations. Accordingly, a pad is generally prepared to give the rig a solid, level foundation. This is done by excavating several (e.g., 10) feet of dirt, and then filling the resulting hole with clay, shale, or some other suitable substrate material. This substrate material is then packed down, and a layer of soil cement may be poured over it, thereby providing a suitably firm and level pad site for the rig.

This process is labor and time intensive. Further, the resulting semi-permanent pad, which is useful for walking the rig while drilling the multiple wells, may remain and impact the environment after drilling operations are complete, or may need to be removed, which can be expensive.

SUMMARY

Embodiments of the disclosure may provide a method for supporting a rig structure, including positioning a plurality of piles in a ground of a core operating section of a pad site, and laying a plurality of mats over the pad site. A first portion of the plurality of mats are at least partially supported by the plurality of piles, and a second portion of the plurality of mats are not supported by the plurality of piles. The first portion of the plurality of mats are configured to support a rig structure.

Embodiments of the disclosure may also provide a pad site including a core operating section and a secondary section defined adjacent to at least a portion of the core operating section. The pad site also includes a plurality of piles installed into a ground. The plurality of piles are distributed in the core operating section. The pad site also includes a first plurality of mats positioned at the core operating section. Each of the first plurality of mats include corners, the corners each being position on top of one of the plurality of piles. The pad site further includes a second plurality of mats that do not engage the plurality of piles and are not positioned over the core operating section of the pad site, the second plurality of mats being positioned over the secondary section.

Embodiments of the disclosure may further provide a method of supporting a drilling rig. The method includes excavating a layer of ground to form a pad site, digging one or more trenches in the pad site, determining a depth, torque, or both for a plurality of helical piles to be installed at the pad site based on one or more characteristics of the ground, one or more characteristics of the plurality of helical piles, and one or more characteristics of the drilling rig to be supported, installing a plurality of helical piles at the determined depth, the determined torque, or both at a core operating section of the pad site, and positioning a plurality of mats on the pad site. A first portion of the plurality of mats are positioned at the core operating section and are at least partially supported by the plurality of helical piles, and a second portion of the plurality of mats are positioned on a secondary section of the pad site and are not supported by the plurality of helical piles. The method further includes laying a layer of gravel over the plurality of mats.

BRIEF DESCRIPTION OF THE DRAWINGS

The accompanying figures, which are incorporated in and constitute a part of this specification, illustrate embodiments of the present teachings and together with the description, serve to explain the principles of the present teachings. In the figures.

Figure 1:
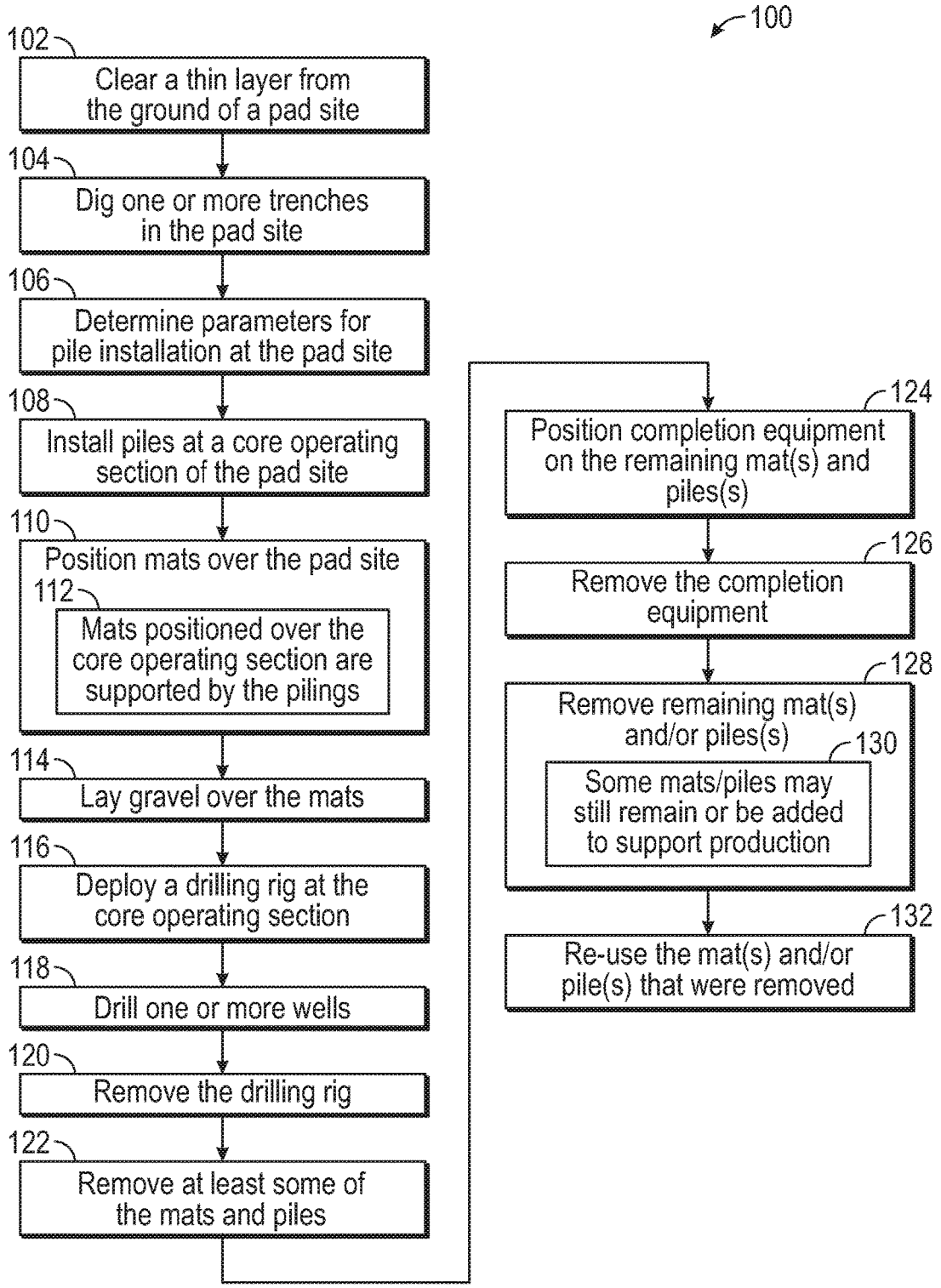
FIG. 1 illustrates a flowchart of a method for supporting a drilling rig, according embodiment.

Some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawings that form a part thereof, and in which is shown by way of illustration a specific embodiment in which the present teachings may be practiced.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. Further, the word "or" should be interpreted non-exclusively wherever possible, i.e., "A or B" means A, B, or both A and B.

Figure 2:
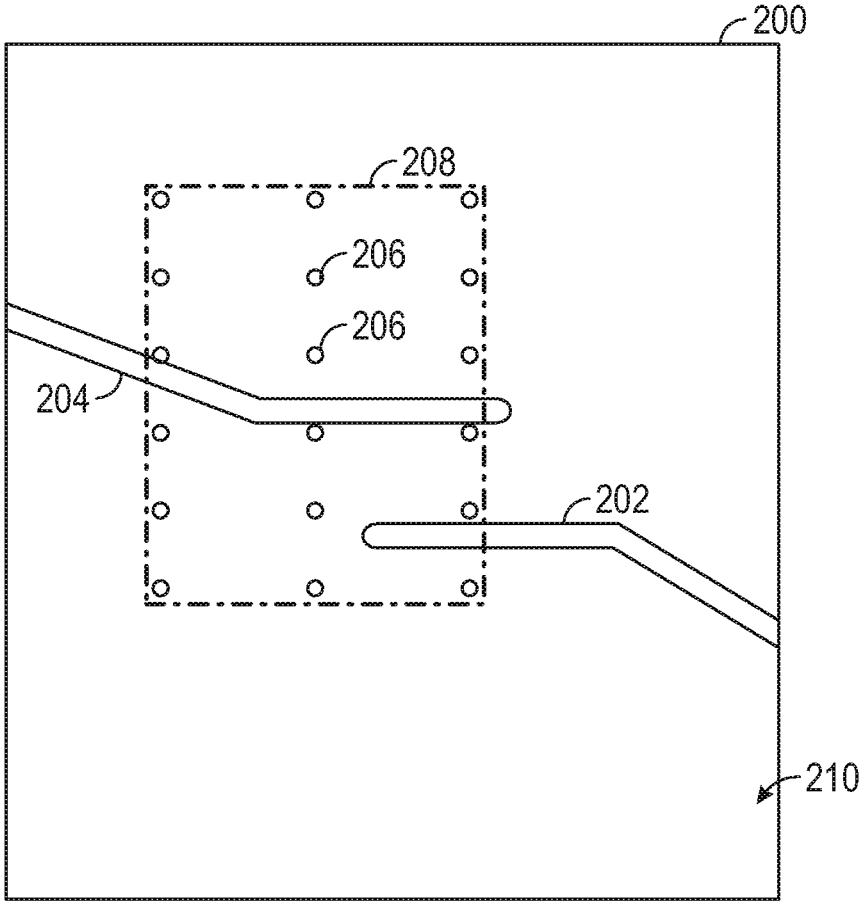
FIG. 2 illustrates a schematic plan view of a pad site at a first stage of the method, according to an embodiment.

The present disclosure may provide a pad site and a method for constructing a pad site and supporting a drilling rig. FIG. 1 illustrates a flowchart of such a method 100, according to an embodiment. The example method 100 will be described herein with reference to the subsequent figures, which provide schematic views of a simplified example of a pad site at various stages during installation and/or components of the pad site. To begin, a thin layer of vegetation and/or dirt may be cleared or otherwise excavated from area to form a pad site, as at 102. FIG. 2 illustrates an example of such a pad site 200, according to an embodiment. The pad site 200 is shown as a square, but it will be appreciated that any suitable geometry may be used.

With continuing reference to FIGS. 1 and 2, the method 100 may proceed to digging one or more trenches (two shown: 202, 204), as at 104. The trenches 202, 204 may serve a variety of purposes, including drainage (e.g., as a French drain), clearance for cables, pipes, etc., and the like. Accordingly, the trenches 202, 204 may be dug to different depths and may extend to different areas, whether to the periphery of the pad site 200 or not, depending on the intended use of the trenches 202, 204.

Before, during, or after digging the trenches 202, 204, the method 100 may include determining parameters for pile installation at the pad site 200, as at 106. The parameters may include, for example, a vertical and/or shear load that is to be supported by the piles. Such parameters may allow for a determination of a torque and/or depth to which piles may be installed in the pad site 200, as will be described in greater detail below. In order to determine the parameters, a variety of physical characteristics of the pad site 200 may be taken into consideration. For example, characteristics of the ground, the piles, and/or the rig that will eventually be supported on the pad site 200 may be considered. In a specific example, the characteristic(s) of the ground may include the type of rock/soil (e.g., clay content, soil density, etc.). Further, the characteristic(s) of the piles may include a geometry of the piles. Additionally, characteristic(s) of the rig to be supported may include a weight of the rig and/or the drill string, casing string, or the like that may be supported thereby (e.g., based on a well plan).

The method 100 may proceed to installing the piles at a core operating section of the pad site 200, as at 108. FIG. 2 illustrates a grid of piles 206 positioned within a core operating section 208 of the pad site 200. Although the piles 206 are shown in a square grid, it will be appreciated that any suitable distribution of the piles 206 in the core operating section 208, which itself may be any suitable shape, may be provided.

The portions of the pad site 200 that are not within the core operating section 208 may be considered the "secondary" section 210 of the pad site 200. This terminology is not used to imply any relative importance of the two sections 208, 210, but merely to distinguish the two sections, upon which different functions may be supported.

Figure 3:
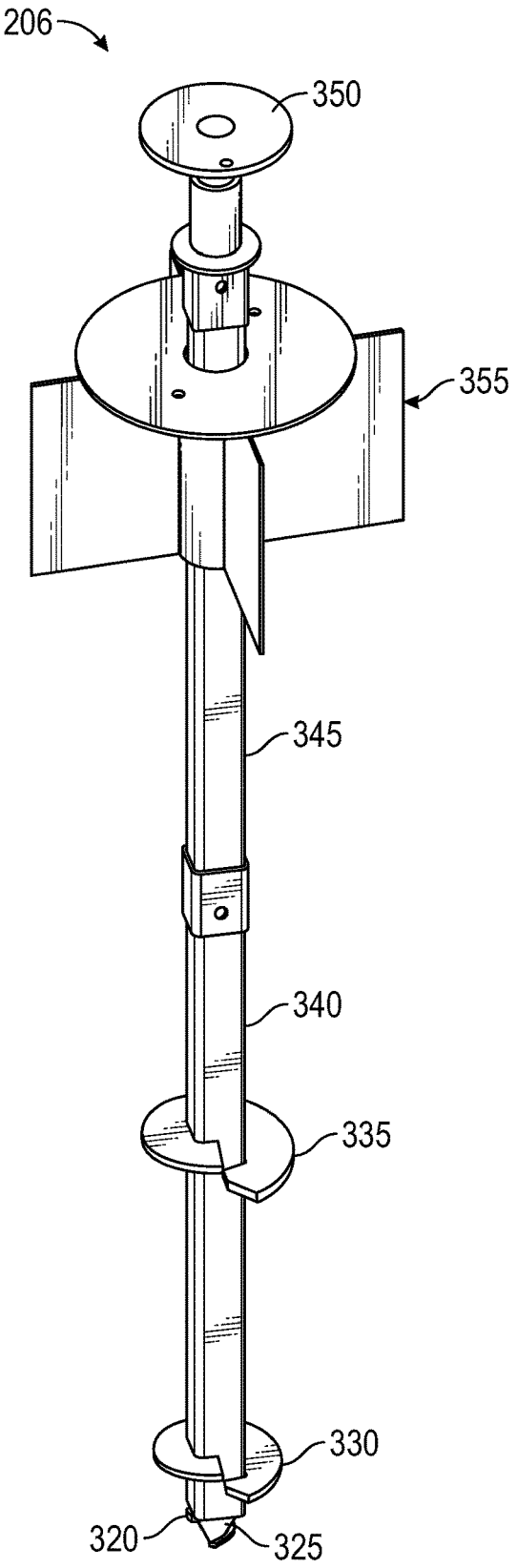
FIG. 3 illustrates a perspective view of a pile that may be employed in the pad site, according to an embodiment.

FIG. 3 illustrates a perspective view of one of the piles 206, according to an embodiment. One, some, or each of the piles 206 may be the same or similar to one or more embodiments of the helical pile assembly discussed and described in U.S. Patent Publication No. 2016/0186402, which is incorporated herein by reference in its entirety, to the extent not inconsistent with the present disclosure. For example, the pile 206 may include a nose 325, a lead 340 (e.g., a tubular member), and a top plate (also referred to as a support member) 350, which may be adjustable vertically (e.g., in a direction parallel to a longitudinal axis of the pile 206) and/or horizontally with respect to the lead 340. The lead 340 and the extension 345 may have a cross-sectional shape that is circular, polygonal (e.g, rectangular), or the like.

The pile 206 may be configured to be advanced into the ground by a downward force, a rotational force, or a combination thereof. Thereafter, the pile 206 may provide support to an external object, such as pipelines, related gas distribution systems, metal safe room, shelter, or other gas and oilfield equipment and structures. The nose 325 may be configured to reduce the resistance and guide the pile 206 as the pile 206 is pressed or rotated downward into the ground. The top plate 350 may be configured to support the external object. The lateral support device 355 may be configured to provide lateral support after the pile 206 is in the ground.

The nose 325 includes a nose helix 320, and the lead 340 includes a first helix 335 and optionally a second helix 335, Each helix 320, 330, 335 may be configured to aid in the advancement of the pile 206 into the ground. Further, the starting points of the helixes 320, 330, 335 may be rotationally aligned. Additionally, the outer diameters of the helixes 320, 330, 335 may increase along the length of the pile 206 from the nose 325 toward the top plate 350. Although three separate helixes 320, 330, 335 are shown in FIG. 3, there may be any number of helixes on the pile 206 without departing from the principles of the present disclosure.

Figure 4:
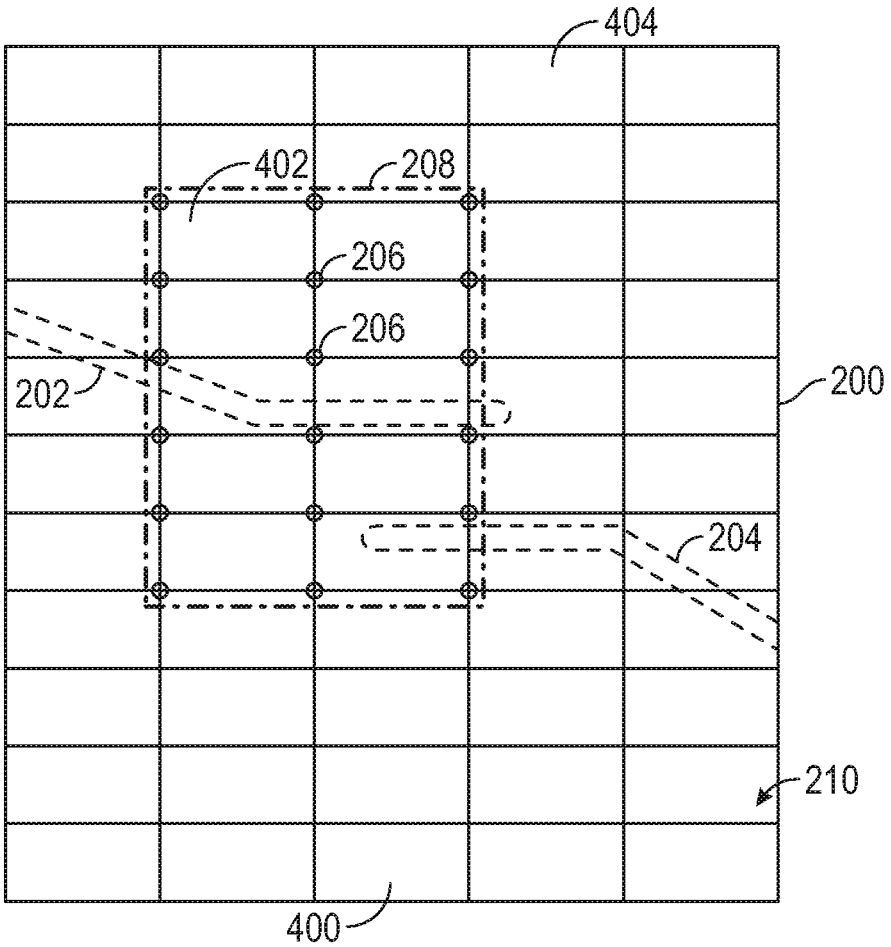
FIG. 4 illustrates a schematic plan view of a pad site at a second stage of the method, according to an embodiment.

Returning to FIG. 1, the method 100 may proceed to positioning mats over the pad site 200, as at 110. In particular, for example, mats positioned over the core operating section 208 are supported by the piles 206, as at 112. Further, mats positioned over the secondary section 210 may not be supported by the piles 206, or may be only partially supported by the piles 206. FIG. 4 illustrates a schematic plan view of the pad site 200 at this stage, according to an embodiment. As shown, mats 400 may be laid over the pad site 200. The mats 400 may be rectangular and made from cement, composite (e.g., fiber-reinforced materials), wood, and/or the like in various embodiments. In other embodiments, the mats 400 may be other shapes and/or may be made from other materials. The mats 400 are shown laid end-to-end and covering the entire pad site 200, although in other embodiments, the mats 400 may be otherwise arranged (e.g., spaced apart or overlapping/interlocking), without departing from the present disclosure.

A first portion (or first plurality of mats) 402 of the mats 400 may be positioned over the core operating section 208, and a second portion (or second plurality of mats) 404 of the mats 400 may be positioned over the secondary section 210. In the illustrated embodiment with rectangular mats 400, the mats 400 may each have four corners, and each of the four corners of the first portion 402 of the mats 400 may engage and be supported by one of the piles 206. In some cases, a single pile 206 may be engaged and may at least partially support the corners of four separate mats 400. Further, each of the second portion 404 of the mats 400 may have at least one (e.g., at least two) corner that is not supported by any of the piles 206, and in some cases, may have no corners supported by any of the piles 206. In some instances, as noted above, the piles 206 may be adjustable by adjusting the height of the top plates 350 of the respective piles 206, e.g., in height. This feature may allow operators to level the mats 400, e.g., the first portion 402 thereof, by adjusting the height at the corners.

Figure 5:
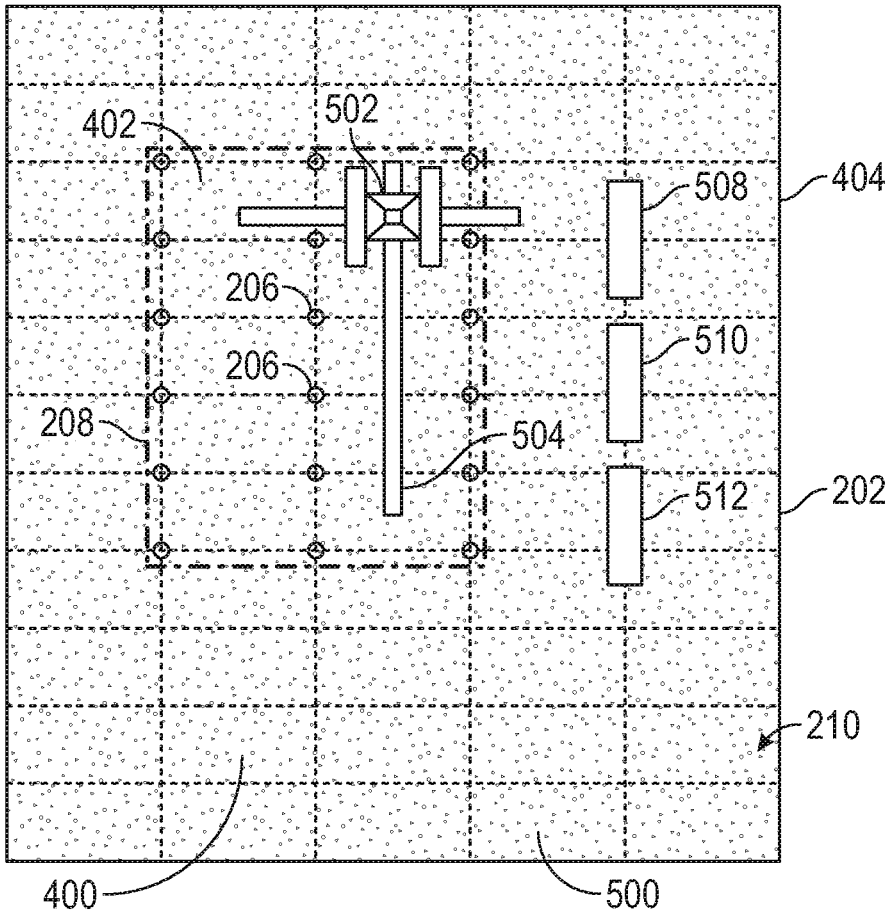
FIG. 5 illustrates a schematic plan view of a pad site at a third stage of the method, according to an embodiment.

Referring again to FIG. 1, the method 100 may proceed to laying gravel over the mats 400, as at 11A. In this disclosure, "gravel" should be broadly construed to refer to substrate suitable for pad construction purposes. One specific example is ¾" gravel, but, again, this is merely one example. The specific type of gravel may be chosen for its drainage capabilities, compaction characteristics, crush-resistance, cost, etc. FIG. 5 illustrates a schematic plan view of the pad site 200 with a layer of gravel 500 covering the mats 400, piles 206, etc.

Still referring to FIGS. 1 and 5, at 116, the method 100 may include deploying a drilling rig 502 to the pad site 200, e.g., specifically to the core operating section 208. The rig 502 may be capable of walking under its own power, that is, moving by operation of legs, wheels, sliders, etc., that are provided as part of or otherwise attached to the substructure, e.g., without substantial disassembly and re-assembly and/or transport using other vehicles. For example, the rig 502 may be movable along a track 504. in some embodiments, two or more well sites may be planned or otherwise located along the walking path of the rig 502 (e.g., along the track 504), and the rig 502 may be capable of moving between the well sites.

While the rig 502 may be supported by the first portion 402 of mats 400 on the core operating section 208, various auxiliary structures (three shown: 508, 510, 512) may be positioned on secondary section 210, e.g., supported by the mats 400 directly on the ground. The auxiliary structures may include equipment that supports the rig operations, e.g., pumps, motors, compressors, generators, hydraulics, trailers, etc.

Referring again to FIG. 1, the method 100 may include drilling one or more wells using the drilling rig 502, as at 118. This may include the rig 502 walking between well sites and drilling the wells. Once the wells are drilled, the method 100 may include removing the drilling rig 502, as at 120, e.g., by disassembling the rig 502 and transporting the rig 502 to another location.

With the rig 502 gone from the pad site 200, drilling activities may be complete; however, various completion operations may still be conducted. The equipment for completion may require a smaller footprint than the drilling rig 502. Accordingly, at least some of the mats 400 and piles 206 may be removed, as at 122. As part of such removal, at least some of the gravel 500 may also be removed to allow access to the mats 400 and/or piles 206. In some cases, the gravel may be placed back over the pad site 200 and/or the mats 400 after the appropriate mats 400 and/or piles 206 are removed.

Figure 6:
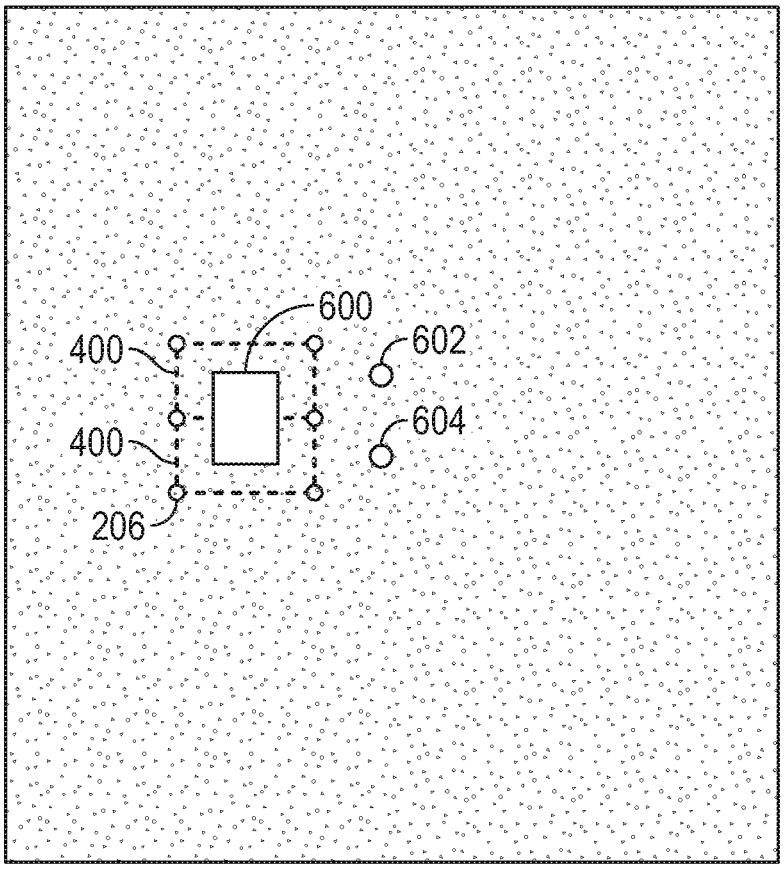
FIG. 6 illustrates a schematic plan view of a pad site at a fourth stage of the method, according to an embodiment.

The method 100 may then include positioning completion equipment on the remaining mats 400 and/or piles 206, as at 124. FIG. 6 illustrates an example of the pad site 200 at this stage, according to an embodiment. As shown, a majority of the mats 400 and piles 206 have been removed. In other cases, only a few of the mats 400 and/or piles 206 may be removed. Those mats 400 and piles 206 that remain may have been part of the core operating section 208, but, in other embodiments, the mats 400 may have been in the secondary section 210.

Completion equipment 600 may be positioned on the remaining mats 400, which may, as shown, be supported by remaining piles 206. Also visible are two wells 602, 604 which were drilled using the drilling rig 502 of FIG. 5. The completion equipment 600 may be used to complete the wells 602, 604.

In some embodiments, the method 100 may also include removing the completion equipment 600 once completion operations are finished, as at 126, and removing the remaining mat(s) 400 and/or pile(s) 206, as at 128. In various embodiments, one or more mat(s) 400 and/or one or more pile(s) 206 may remain, e.g., to support equipment used in producing the wells 602, 604 (e.g., flowback fluid tanks, etc.), as indicated at 130. In other embodiments, all of the mats 400 and all of the piles 206 may be removed from the pad site 200. In addition, the gravel 500 may be removed. Once the equipment, gravel 500, mats 400, and piles 206 are removed, the pad site 200 may be returned to its initial state, prior to the initiation of the method 100, but for the presence of the wells 602, 604 and associated production equipment. This may reduce the environmental impact of the construction of the wells 602, 604.

Further mitigating the environmental impact, and potentially adding to cost-savings, the piles 206 and/or the mats 400, which have been removed from the pad site 200, may be reused for construction of other pad sites, as at 132. Thus, the method 100 may be started over again for another site, and may employ the same piles 206 and/or mats 400, potentially dozens or more times.

While the present teachings have been illustrated with respect to one or more implementations, alterations and/or modifications may be made to the illustrated examples without departing from the spirit and scope of the appended claims. in addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for supporting an oilfield rig structure, comprising:

positioning a plurality of piles in a ground of a core operating section of a pad site;

laying a plurality of mats over the pad site, wherein a first portion of the plurality of mats are at least partially supported by the plurality of piles, and a second portion of the plurality of mats are not supported by the plurality of piles, and wherein the first portion of the plurality of mats are configured to support an oilfield rig structure; and spreading a layer of gravel over the first portion of the plurality of mats.

2. The method of claim 1, further comprising determining a torque, a depth, or both for positioning the plurality of piles based on one or more characteristics of the ground and one or more characteristics of the oilfield rig structure, wherein positioning the plurality of piles comprises drilling the plurality of piles into the ground at the determined torque, depth, or both.

3. The method of claim 1, further comprising spreading the layer of gravel over the second portion of the plurality of mats.

4. The method of claim 1, further comprising adjusting a height of at least one of the plurality of piles after drilling the at least one of the plurality of piles into the ground.

5. The method of claim 1, further comprising:

supporting the oilfield rig structure on the first portion of the plurality of mats at the core operating section of the pad site;

drilling a wellbore using the oilfield rig structure while the oilfield rig structure is supported on the first portion of the plurality of mats;

moving the oilfield rig structure on the first portion of the plurality of mats; and drilling a second wellbore using the oilfield rig structure after moving the rig structure.

6. The method of claim 1, further comprising digging one or more trenches in the ground prior to laying at least some of the plurality of mats over the pad site.

7. The method of claim 1, further comprising:

removing at least some of the plurality of mats;

removing at least some of the plurality of piles; and re-using the at least some of the plurality of mats and the at least some of the plurality of piles.

8. The method of claim 1, wherein the plurality of mats each include corners, wherein laying the mats comprises laying the first portion of the plurality of mats such that the corners thereof are each on top of one of the plurality of piles.

9. The method of claim 1, wherein the second portion of the plurality of mats are configured to support auxiliary structures.

10. The method of claim 1, wherein at least one of the piles is configured to support corners of four of the plurality of mats.

11. A pad site comprising:

a core operating section;

a secondary section defined adjacent to at least a portion of the core operating section;

a plurality of piles installed into a ground, wherein the plurality of piles are distributed in the core operating section;

a first plurality of mats positioned at the core operating section, each of the first plurality of mats comprising corners, the corners each being position on top of one of the plurality of piles;

a second plurality of mats that do not engage the plurality of piles and are not positioned over the core operating section of the pad site, the second plurality of mats being positioned over the secondary section; and a layer of gravel positioned over the first plurality of mats.

12. The pad site of claim 11, wherein each of the first plurality of mats and each of the second plurality of mats are made from concrete.

13. The pad site of claim 11, wherein the layer of gravel is positioned over the second plurality of mats.

14. The pad site of claim 11, further comprising one or more trenches in the ground below the first plurality of mats, below the second plurality of mats, or both.

15. The pad site of claim 11, wherein the plurality of piles are helical piles, the helical piles being torqued to a predetermined torque load and installed to a predetermined depth.

16. The pad site of claim 15, wherein the helical piles have an adjustable height, to level the first plurality of mats.

17. The pad site of claim 15, further comprising an oilfield drilling rig that is movable on the first plurality of mats and is supported by the first plurality of mats and the plurality of piles.

18. The pad site of claim 11, wherein at least some of the first plurality of mats, at least some of the second plurality of mats, and at least some of the plurality of piles are removable for re-use at another pad site.

19. A method of supporting an oilfield drilling rig, the method comprising:

excavating a layer of ground to form a pad site;

digging one or more trenches in the pad site;

determining a depth, torque, or both for a plurality of helical piles to be installed at the pad site based on one or more characteristics of the ground, one or more characteristics of the plurality of helical piles, and one or more characteristics of the drilling rig to be supported;

installing a plurality of helical piles at the determined depth, the determined torque, or both at a core operating section of the pad site;

positioning a plurality of mats on the pad site, wherein a first portion of the plurality of mats are positioned at the core operating section and are at least partially supported by the plurality of helical piles, and wherein a second portion of the plurality of mats are positioned on a secondary section of the pad site and are not supported by the plurality of helical piles; and laying a layer of gravel over the first portion of the plurality of mats.

20. The method of claim 19, further comprising:

positioning an oilfield rig at a first well site of the core operating section of the pad site, wherein the oilfield drilling rig positioning at the core operating section is supported by at least one of the first portion of the plurality of mats and at least one of the plurality of helical piles;

drilling a first wellbore in the ground at the first well site;

moving the oilfield drilling rig on the core operating section to a second well site, the oilfield drilling rig being supported by at least one of the first portion of the plurality of mats and at least one of the plurality of helical piles while moving the oilfield drilling rig; and drilling a second well at the second well site.

21. The method of claim 19, further comprising:

removing the layer of gravel;

removing at least some of the plurality of mats and at least some of the plurality of helical piles; and re-using the at least some of the plurality of mats and the at least some of the plurality of helical piles in another pad site.

22. The method of claim 19, wherein:

the one or more characteristics of the ground comprise rock content or soil content;

the one or more characteristics of the plurality of helical piles comprise a geometry of the plurality of helical piles; and the one or more characteristics of the oilfield drilling rig comprises a weight of the oilfield drilling rig.

* * * * *